US007316462B2

(12) United States Patent
Usui et al.

(10) Patent No.: US 7,316,462 B2
(45) Date of Patent: Jan. 8, 2008

(54) INK JET RECORDING APPARATUS

(75) Inventors: Minoru Usui, Nagano (JP); Hitotoshi Kimura, Nagano (JP); Nobuhito Takahashi, Nagano (JP); Shuhei Harada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 83 days.

(21) Appl. No.: 09/979,755

(22) PCT Filed: Mar. 27, 2001

(86) PCT No.: PCT/JP01/02445

§ 371 (c)(1),
(2), (4) Date: Jan. 15, 2002

(87) PCT Pub. No.: WO01/72522

PCT Pub. Date: Oct. 4, 2001

(65) Prior Publication Data

US 2002/0158954 A1 Oct. 31, 2002

(30) Foreign Application Priority Data

Mar. 27, 2000 (JP) ..... 2000-86020
Feb. 9, 2001 (JP) ..... 2001-34187

(51) Int. Cl.
*B41J 29/38* (2006.01)
*B41J 23/00* (2006.01)
*B41J 2/175* (2006.01)

(52) U.S. Cl. ..... 347/5; 347/37; 347/85

(58) Field of Classification Search ..... 347/2, 347/5–7, 104, 19, 84–86, 117, 40–42, 29, 347/37

See application file for complete search history.

(56) References Cited

U.S. PATENT DOCUMENTS

| | | | | |
|---|---|---|---|---|
| 5,428,375 | A * | 6/1995 | Simon et al. | 347/12 |
| 5,587,730 | A | 12/1996 | Karz | |
| 5,596,416 | A | 1/1997 | Barry et al. | 358/296 |
| 6,238,115 | B1 * | 5/2001 | Silverbrook et al. | 400/693 |
| 6,264,318 | B1 * | 7/2001 | Oda et al. | 347/86 |
| 6,273,545 | B1 | 8/2001 | Oide | |
| 6,276,784 | B1 * | 8/2001 | Ikkatai et al. | 347/85 |
| 6,364,451 | B1 * | 4/2002 | Silverbrook | 347/42 |
| 6,488,348 | B1 * | 12/2002 | Miura et al. | 347/6 |
| 6,493,106 | B1 * | 12/2002 | Gauthier et al. | 347/5 |
| 6,543,877 | B1 | 4/2003 | Boutet et al. | |

FOREIGN PATENT DOCUMENTS

EP 0 835 761 A2 4/1998

(Continued)

*Primary Examiner*—An H. Do
(74) *Attorney, Agent, or Firm*—Sughrue Mion, PLLC

(57) ABSTRACT

A plurality of recording engines, each including an ink jet recording head mounted on a carriage, which ejects an ink droplet onto a recording sheet to perform printing are arranged such that recording sheets are feedable via different feeding paths. Ink is supplied from a main tank common to the respective recording engines. A controller compares an amount of an externally provided print data with an amount of a reference data. The controller divides the print data into data sets, each corresponding to a predetermined amount of page, and provides the data sets to the plural recording engines, when the print data amount exceeds the reference data amount. The controller operates a single recording engine when the print data amount is less than the reference data amount.

24 Claims, 6 Drawing Sheets

FOREIGN PATENT DOCUMENTS

| | | | | |
|---|---|---|---|---|
| EP | 0 904 940 | A2 | 3/1999 | |
| EP | 0 904 940 | A3 | 3/1999 | |
| EP | 0 927 638 | A2 | 7/1999 | |
| EP | 0927638 | A2 * | 7/1999 | ..... 347/7 |
| JP | 50-87398 | | 7/1975 | |
| JP | 53-45723 | | 12/1978 | |
| JP | 58-57962 | | 4/1983 | |
| JP | 04358844 | A * | 12/1992 | |
| JP | 6-315519 | | 11/1994 | |
| JP | 07-256984 | | 10/1995 | |
| JP | 11-157093 | | 6/1999 | |
| JP | 11-170573 | | 6/1999 | |
| JP | 11-192720 | | 7/1999 | |
| JP | 11-338664 | | 12/1999 | |
| JP | 2000-185411 | | 7/2000 | |
| JP | 2000-327964 | | 11/2000 | |
| WO | WO 00/09339 | | 2/2000 | |

* cited by examiner

INK JET RECORDING APPARATUS

TECHNICAL FIELD

The present invention relates to a recording apparatus which incorporates an ink jet recording head for ejecting ink droplets.

BACKGROUND ART

High-speed printing of large volume documents has been performed by use of a page printer equipped with a xerographic recording engine. However, the page printer poses a problem of an increase in power consumption and noise in association with the high-speed characteristic of the page printer, as well as a problem of a complex structure which deteriorates reliability.

In order to solve the problem, there has been proposed construction of a recording apparatus by arranging a plurality of low-cost, low-noise ink jet recording heads or employing a lengthy ink jet recording head covering an entire paper width.

The recording apparatus of the former construction enables an increase in printing speed. However, since a plurality of recording heads are integrated, complicated maintenance is required. The recording apparatus of the latter construction requires design of a recording head with a new configuration, thereby incurring initial costs.

U.S. Pat. No. 5,596,416 has proposed that a controller collectively control a plurality of recording apparatuses having the same construction provided in a rack. The technique enables use of general-purpose recording apparatuses, thereby reducing costs. However, the ink jet recording apparatus cannot be employed hastily as such a general-purpose apparatus.

In general, low-cost ink jet recording apparatuses forgeneral use are constructed such that ink cartridges are provided on a carriage. Hence, restrictions are imposed on the amount of ink for ensuring a carriage speed. In the field of applications where a large volume of print products are produced commercially, much time is required for replenishing the cartridges with ink.

Consequently, it is an object of the present invention to provide an ink jet recording apparatus which simplifies replenishment of cartridges with ink while an attempt is made to curtail costs and which enables high-speed printing operation with high reliability.

DISCLOSURE OF THE INVENTION

According to the present invention, there is provided an ink jet recording apparatus, comprising:

a plurality of recording engines, each including an ink jet recording head mounted on a carriage, which ejects an ink droplet onto a recording sheet to perform printing; and a common main tank, to which the plural recording engines are connected via flow passages. The present invention provides an ink jet recording apparatus, comprising:

In this configuration, ink can be supplied to the respective recording engines from a common main tank even when commercially-available general-purpose apparatuses are used as recording engines. As a result, replenishment the ink cartridges with ink and management of ink become simple.

BEST MODE FOR CARRYING OUT THE INVENTION

Figure 1:
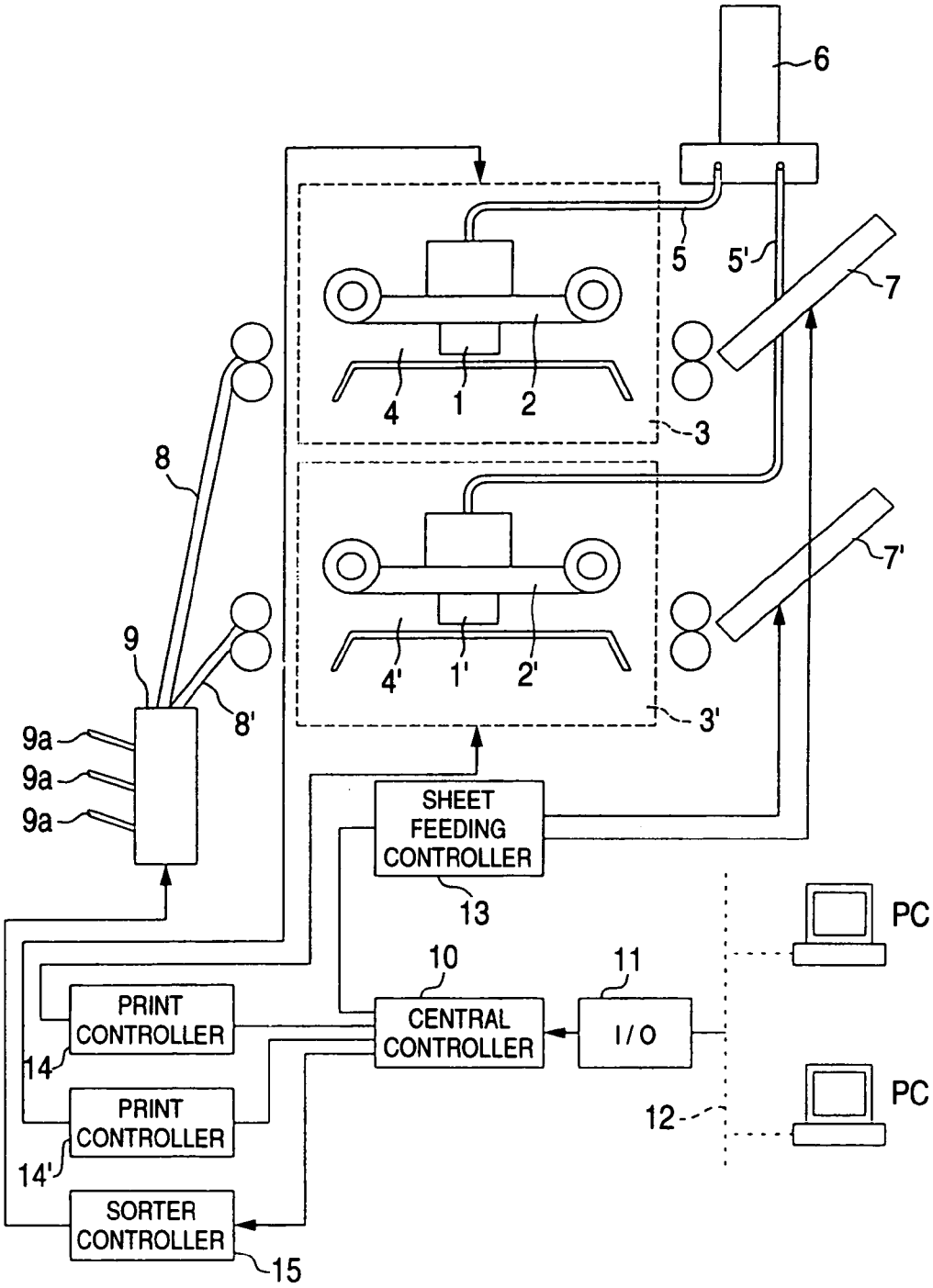
FIG. 1 is a block diagram showing an ink jet recording apparatus according to one embodiment of the present invention.

FIG. 1 shows one embodiment of the present invention. Ink jet recording heads 1 and 1' are mounted on carriages 2 and 2' for ejecting ink droplets from nozzle orifices. Recording engines 3 and 3' perform printing operation by moving the recording heads 1 and 1' back and forth in a widthwise direction of a recording medium. In the present embodiment, the recording engines 3 and 3' are arranged so as to oppose to sheet transporting paths 4 and 4', respectively. The recording engines 3 and 3' are connected to a common main tank 6 via ink supply tubes 5 and 5', respectively. Cut sheet feeders 7 and 7' are disposed upstream of the recording sheet transport paths 4 and 4', respectively. A sorter 9 having sheet collation and sheet sorting functions is disposed downstream of the paper transport paths 4 and 4' via sheet discharging paths 8 and 8'.

A central controller 10 receives print data via a communications line 12 such as a LAN connected to an interface 11. When a predetermined reference volume of data; for example, print data pertaining to 3 pages or more, have been input to the central controller 10, the print data are divided into pages determined by format data. A sheet feeding controller 13 supplies sheets from the respective cut sheet feeders 7 and 7' to the recording engines 3 and 3'. Recording controller 14 and 14' cause the recording engines 3 and 3' to perform printing operation, and a sorter controller 15 controls the sorter 9 so as to collate printed sheets and discharging the sheets to trays 9*a*.

When data, less than the reference volume (i.e., a reference number of pages), is input to the central controller 10, the central controller 10 selects the recording engine 3. Print data is output to the print controller 14, thereby causing the recording apparatus to perform printing operation. The thus-printed recording sheet is sorted and output to a specific tray 9*a* by the sorter 9.

In the embodiment, when print data is output from a client personal computer (hereinafter, simply referred as PC) connected to the LAN, the central controller 10 determines the volume of input print data. When the print data is associated with several pages, the data is divided into page data determined by a print format. Consecutive pages; that is, two pages in the embodiment, are output from the print controller 14 and 14'.

Simultaneously, the sheet feeding controller 13 supplies recording sheets to the recording engines 3 and 3' from the cut sheet feeders 7 and 7'. The first control engine 3 prints a first page, and the second control engine 3' prints a second page. When printing of data corresponding to the first and second pages has been completed, the sorter controller 15 controls the sorter 9. The thus-printed recording sheets are collated and output to the trays 9*a*.

In this manner, when the recording engines 3 and 3' have completed printing operations, the central controller 10 assigns subsequent pages; that is, a third page and a fourth page, to the print controller 14 and 14', thereby performing printing operation.

When print data of small volume have been output from a plurality of client PCs, the central controller 10 selects a recording engine that is currently idle; e.g., the second recording engine 3', and print data are output to the print controller 14'. The sheet feeding controller 13 supplies a recording sheet from the sheet feeder 7' of the recording engine 3'.

When print data has been input from another client PC during the printing operation of the second recording engine 3', the central controller 10 determines whether or not any of the recording engines are currently idle. In this case, the first recording engine 3 is currently idle, and the input print data is output to the print controller 14. The sheet feeding controller 13 causes the sheet feeder 7 to supply a recording sheet to the recording engine 3, thereby performing printing operation.

As a result, two different print data sets can be printed simultaneously. The recording sheets that have finished undergoing printing are divided into and output to different trays 9*a* by the sorter controller 15.

In a case where one file mixedly includes text data and image data and where there are areas which greatly differ from each other in per-page print time, one recording engine prints image data, and another recording engine consecutively prints a plurality of pages. Thus, recording engines can be operated asynchronously.

The present embodiment has described a case where a plurality of PCs are connected together by way of a LAN. It is also evident that the present embodiment can be applied to a case where the recording apparatus is connected directly to a parallel port of a PC by changing the interface connector.

There can also be employed a configuration in which an information reader for reading information from storage medium, such as "compact flash memory" or "smart media", a display for displaying the information read by the reader, and a print instruction provider are integrated together.

Figure 2:
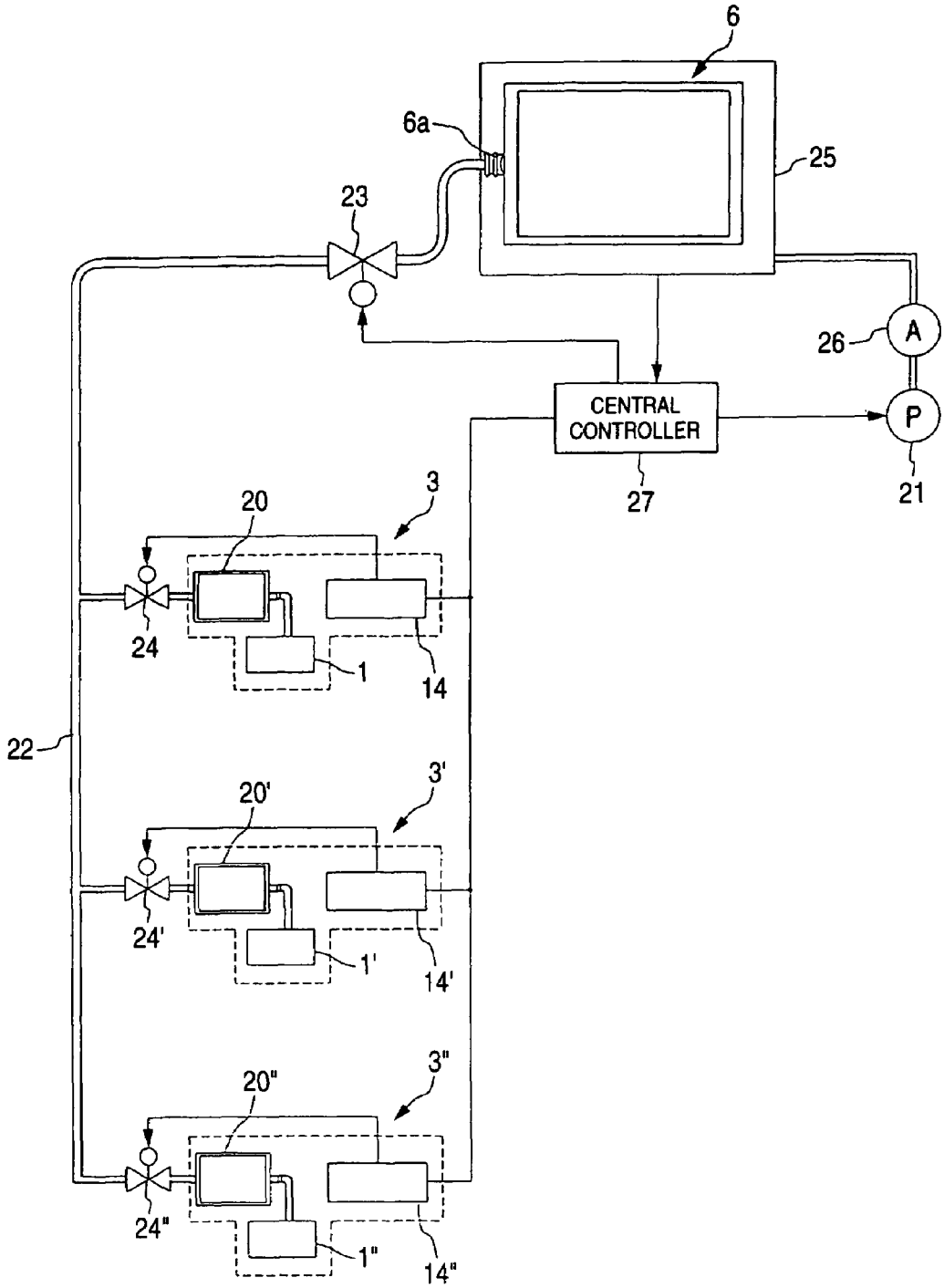
FIG. 2 is a block diagram showing a system for supplying ink to the recording apparatus.

FIG. 2 shows one embodiment of a system suitable for supplying ink from a single main tank to a plurality of recording engines. In this embodiment, ink is supplied from the single main tank 6 to three recording engines.

In the present embodiment, the recording engines 3, 3' and 3" are equipped with subtanks 20, 20' and 20", respectively. The recording heads 1, 1' and 1" are provided with ink supply from the common main tank 6 by way of the subtanks 20, 20' and 20", respectively.

The subtanks 20, 20' and 20" are connected to a main tube 22 by way of electro-magnetic valves 24, 24' and 24", respectively. The main tube 22 is connected to an ink supply port 6*a* of the common main tank 6 by way of a main electro-magnetic valve 23.

The main tank 6 is constituted of a flexible bag and is removably housed in an airtight container 25 to which air is supplied from an air pump 21. By such a construction, air is supplied to the airtight container 25 from the air pump 21, thereby effecting forcible discharge of ink. Reference numeral 26 designates an accumulator which prevents fluctuations in pressure of the air pump 21.

A central controller 27 is connected to the print controller 14, 14', and 14" of the respective recording engine 3, 3', and 3". The central controller 27 controls operation of the air pump 21 upon receipt of ink level signals from the print controller 14, 14', and 14". The print controller 14, 14', and 14" control the electro-magnetic valves 24, 24', and 24" in accordance with an ink level detector provided in the respective subtanks 20, 20', and 20", thereby selectively supplying ink to desired subtanks from the common main tank 6.

Figure 3A:
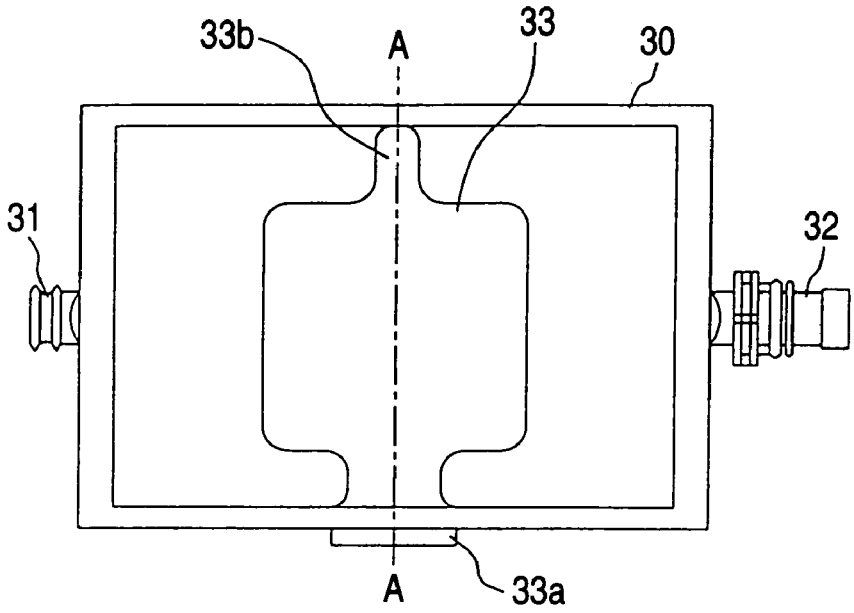
FIG. 3A is a front view showing a subtank incorporated in the system.
Figure 3B:
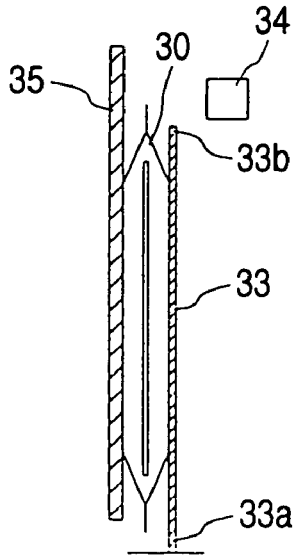
FIG. 3B is a cross-sectional of the subtank taken along a line A-A.
Figure 4:
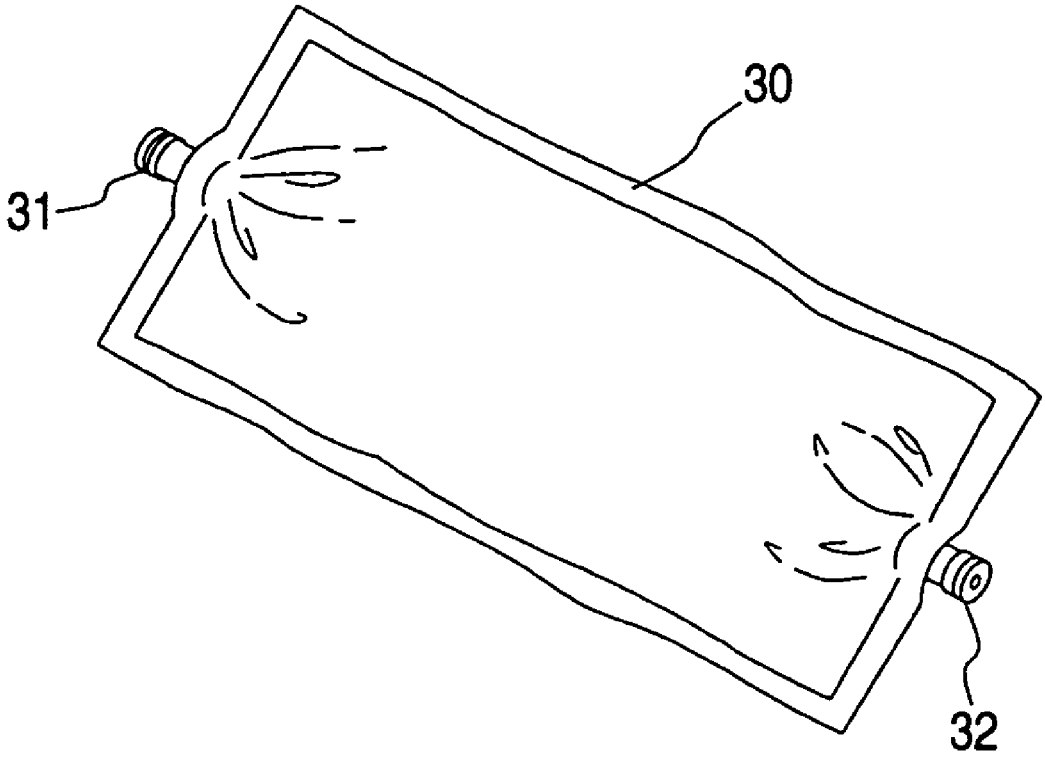
FIG. 4 is a perspective view showing a bag constituting the subtank.

FIGS. 3A, 3B and 4 show one embodiment of the subtank. Here, the subtank 20 is taken as an example. The subtank 20 comprises: an airtight bag 30 having a capacity of 100-300 cc, which is a size allowing flexible volume change in accordance with change of ink amount therein; an inlet port 31 connected to the main tube 22 and an outlet port 32 connected to the recording head, which are provided in opposing sides of the bag 30. An aluminum laminate film can be used for the bag 30. The laminate film is made by taking, e.g., aluminum foil as an intermediate layer for ensuring gas barrier characteristics, and sandwiching the aluminum film between two films; e.g., an external nylon film and an internal polyethylene film. A translucent film can also be employed. Silicon oxide is deposited on the surface of a macromolecular film, such as a polyethylene terephthalate (PET) or nylon, having a translucent characteristic, as well as visibility and gas tightness, thereby forming a silicon oxide layer. A macromolecular film, such as polyethylene, having a superior thermal welding characteristic, is stacked on the surface of the silicon oxide layer, thereby forming the translucent film.

Since the subtank 20 is variable in volume thereof in accordance with variations of amount of ink therein, a plate member 33 which is pivotable about one side edge 33*a* is brought into contact with the subtank 20 to form the ink level detector. The ink level detector 34 is constructed such that displacement of the other side edge 33*b* of the plate member 33 is detected by an electrical or optical sensor. Reference numeral 35 designates a fixation base.

Upon receipt of a print instruction, the central controller 27 sends an instruction to the print controller 14, 14', and 14" of the recording engines 3, 3', and 3". In accordance with the received print instruction, the print controller 14, 14', and 14" of the recording engines 3, 3', and 3" commence printing of delivered print data. On the basis of the signal output from the ink level detector 34, the amounts of ink remaining in the subtanks 20, 20', and 20" are checked periodically.

When the amount of ink remaining in the subtank 20 has dropped to a minimum level as a result of printing operation, a message is transmitted to the central controller 27. The central controller 27 drives the air pump 21 and opens the main electromagnetic valve 23. The print controller 14 of the recording engine 3 opens the electromagnetic valve 24.

As a result, the ink in the main tank 6 to which air has been supplied from the air pump 21 is pressurized, and ink flows into the subtank 20 of the recording engine 3, whose electro-magnetic valve 24 is opened. Since electro-magnetic valves 24' and 24" of the recording engines 3' and 3' which do not require replenishment remain in a closed state, ink does not affect the electro-magnetic valves 24' and 24" during replenishing operation.

When the ink level detector 34 has detected that the subtank 20 has been replenished with a predetermined amount of ink, the print controller 14 closes the electro-magnetic valve 24 and sends a signal to the central controller 27.

The central controller 27 stops the air pump 21 and closes the main electro-magnetic valve 23. When the amount of ink remaining in the other recording engine 3' has dropped to a minimum level while one recording engine is being replenished with ink, the central controller 27 drives the air pump 21 while the main electromagnetic valve 23 is opened, until the central controller 27 receives an ink supply stop signal from all the recording engines.

In this way, when the ink of the main tank 6 has dropped to a minimum level, the central controller 27 informs the user of this situation and prompts replacement of the main tank 6. Even in this state, ink still remains in the subtanks 20, 20', and 20" of the recording engines 3, 3', and 3", and hence printing operation can be performed continuously. Thus, the user is required to control only the ink remaining in one main tank 6, thereby facilitating checking of the residual ink amount.

By arranging such that head differences between the respective subtanks and the associated recording engines, and lengths of the respective ink supply passage are made constant, ink is stably supplied to each recording head from each subtank. Since ink is forcibly supplied by the air pump 21, a positional relationship between the main tank 6 and the recording engines 3, 3', and 3" and a mutual positional relationship between the recording engines 3, 3', and 3" may be arranged in a horizontal or vertical direction.

In an ink jet recording head, ink is ejected from narrow nozzle orifices. Hence, the nozzle orifices are likely to be clogged by drying of ink, thereby inducing print failures. For this reason, the ink jet recording head is provided with so-called an ejection recoverer. More specifically, the ejection recoverer seals a nozzle formation face of the recording head with a cap, and ink is forcibly discharged from the nozzle orifices by a suction pump.

Figure 5:
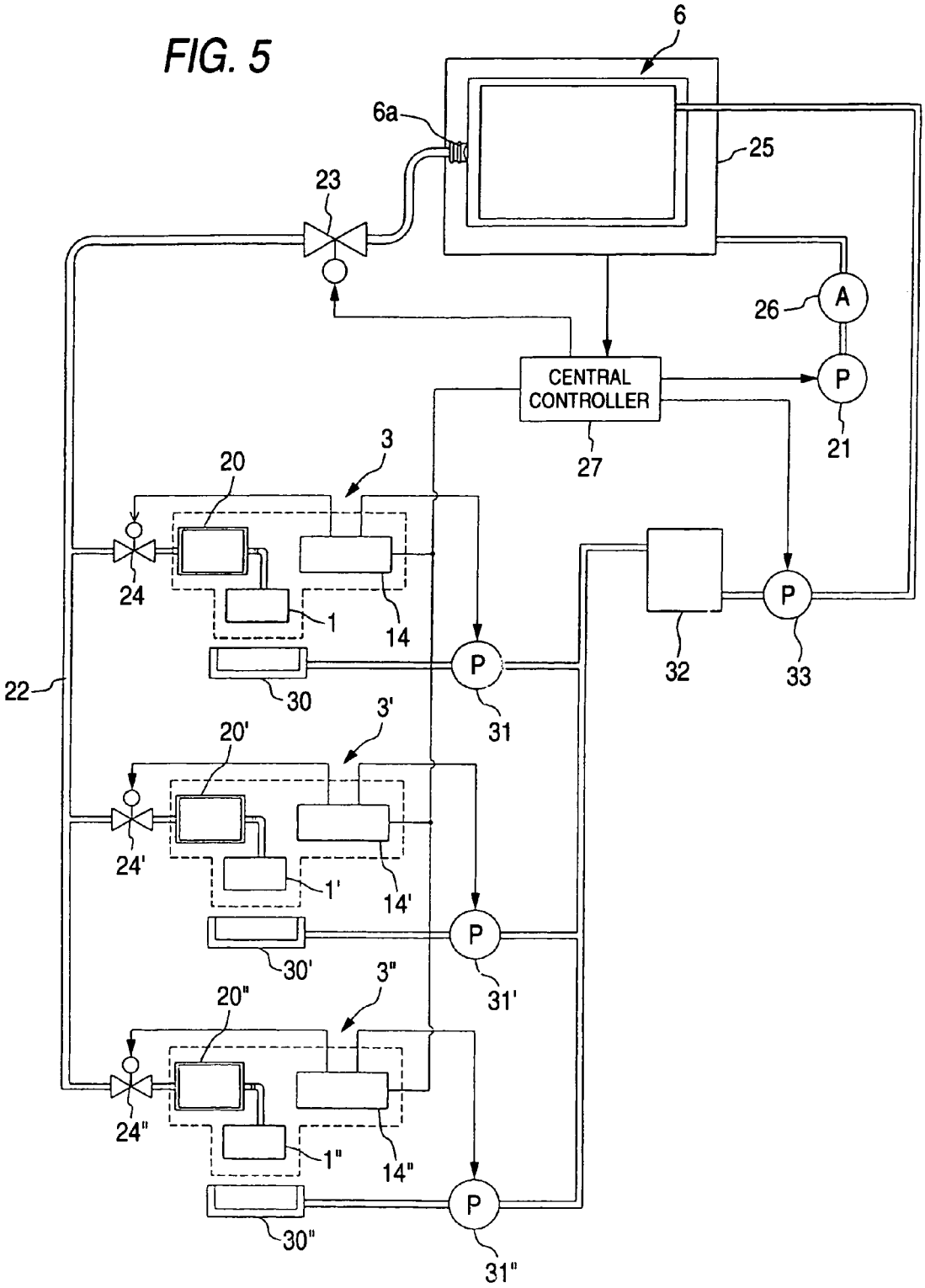
FIG. 5 is a block diagram showing an ink supply system incorporated in a recording apparatus according to another embodiment of the present invention.

FIG. 5 shows an ink supply system provided with such an ejection recoverer. Capper 30, 30', and 30" for sealing nozzle formation face of the respective recording heads are disposed in non-printing areas on paths along which the recording heads 1, 1', and 1" of the recording engines 3, 3', and 3" travel. Suction ports of suction pumps 31, 31', and 31" are connected to the capper 30, 30', and 30". Discharge ports of the suction pumps 31, 31', and 31" are connected to an ink purifier 32. The ink purifier 32 houses a gas-liquid separation mechanism or a filter for filtering out air bubbles or foreign material contained in the ink output from the recording head. The ink purifier 32 is connected to a pump 33, and the ink output from the recording head is fed back to the main tank 6.

In the present embodiment, when the recording heads 1, 1', and 1" of the recording engines. 3, 3', and 3" need to perform ejection recovery operation, the print controller 14, 14', and 14" move the recording heads 1, 1', and 1" to the positions of the capper 30, 30', and 30". As a result, the nozzle formation face of the recording heads 1, 1', and 1" are closed by the capper 30, 30', and 30".

The suction pumps 31, 31', and 31" are actuated, thereby causing the recording heads 1, 1', and 1" to forcibly discharge ink. As a result, the foreign matter sticking to the nozzle orifices is flushed away with ink and flows into the ink purifier 32.

When a predetermined amount of waste ink is stored in the ink purifier 32 as a result of iteration of such an ejection recovery operation, the central controller 27 activates the pump 33, thereby recovering ink to the main tank 6.

The recording heads 1, 1', and 1" can be maintained in a printable state at all times without involvement of unnecessary consumption of ink and without a necessity for disposing of wastes.

Although the ink purifier 32 can completely remove foreign matter included in waste ink, the viscosity of ink is considered to increase as a result of vaporization of ink solvent. It is desirable to provide the main tank 6 or the ink purifier 32 with a mechanism for injecting an ink solvent therein.

Figure 6:
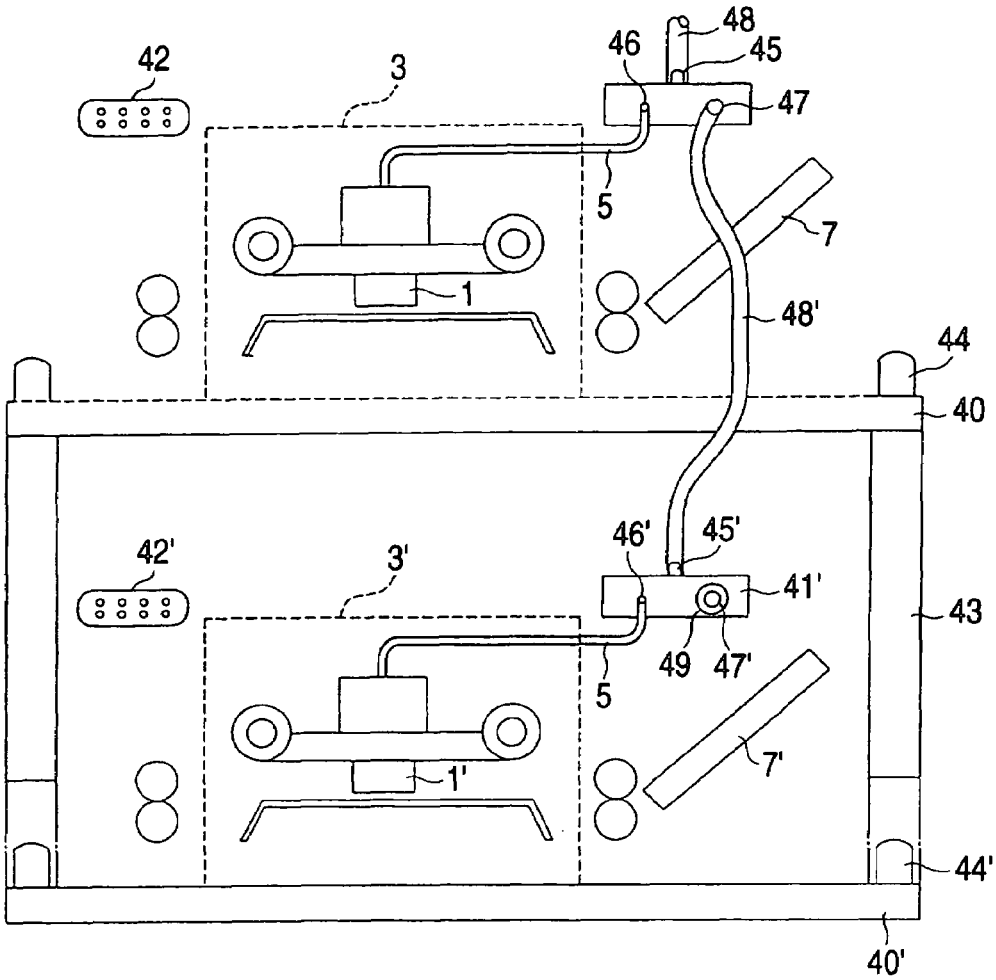
FIG. 6 is a block diagram showing another embodiment, in which the recording engines and flow-passage connectors are integrated into a unit.

FIG. 6 shows a recording unit according to one embodiment of the present invention. At least the recording engine 3 is mounted on a table 40. A flow passage connector 41 and an electrical connector 42 are arranged on the table 40, thereby constructing a unit.

Legs 43 which is slightly longer than a height of the recording head is provided on a lower face of the table 40, and fitting members 44 fitted with the associated legs 43 is formed on an upper face of the table 40. Main connection ports 45, 45' to be connected to another recording unit or a common main tank, ink supply ports 46, 46' to be connected to the recording head 1, 1' and distribution ports 47, 47' to be connected another recording engine are provided with the flow passage connectors 41, 41', respectively.

In the embodiment, the main connection port 45 of one recording unit is connected to the main tank by way of a tube 48, and the distribution port 47 is connected to the main connection port 45' of another recording unit. The distribution port 47' of the unit serving as a terminal is covered with a blank cap 49. Such a connection facilitates increase in the number of recording units within the ink supply capability of the recording apparatus. Removal of the recording units can be also facilitated.

In this embodiment, such arrangement that at least one recording head (unit) is used for recording with black ink, and another recording unit stacked on the above recording unit is used for recording with color ink can be easily configured. When the recording units are configured to be used for only color printing purpose, identical main tanks are provided for reserving ink of respective colors. The recording apparatus can be constructed from a plurality of recording heads associated with respective colors, and a plurality of subtanks which supply ink to the recording heads and receive ink from the main tanks of respective colors. In a case where the recording apparatus is configured in this manner, each recording engine may be constructed as a plurality of independent recording heads. Alternatively, the recording engine can be constituted as a single recording head having a plurality of rows of nozzle orifices which can independently eject different types of ink.

INDUSTRIAL APPLICABILITY

As has been described, since replenishment and management of ink are simplified, a recording engine is realized by a printing mechanism constituting a low-cost, reliable terminal printer. Further, simultaneous printing of a plurality of print data sets as well as high-speed printing operation can be performed by independently activating individual recording engines.

The recording engines can be assembled simply into a unit. Even if one print mechanism is in trouble, recovery can be easily effected by merely replacing one engine provided as a unit so that simplification of maintenance can be attained. In addition, if tables, flow passage connectors, and electrical connectors are constructed in compliance with identical specifications, unit addition can be easily performed.

Further, combined use of a plurality of recording engines which differ from each other in terms of adaptable recording width and the kind of paper enables provision of a low-cost recording apparatus that is readily customized to the client's desires.

The invention claimed is:

1. An ink jet recording apparatus, comprising:

a first recording engine, including a first carriage and a first ink jet recording head mounted on the first carriage and operable to eject ink onto a recording sheet; and a second recording engine, including a second carriage and a second ink jet recording head mounted on the second carriage and operable to eject the ink onto the recording sheet;

a common main tank, operable to store the ink so as to supply the ink to the first recording engine and the second recording engine;

a first flow passage, through which the first recording engine is connected to the common main tank to supply the ink from the common main tank to the first recording engine; and a second flow passage, through which the second recording engine is connected to the common main tank to supply the ink from the common main tank to the second recording engine.

2. The ink jet recording apparatus as set forth in claim 1, further comprising:

a first sub tank, interposed between the common main tank and the first recording head and operable to store the ink so as to supply the ink to the first recording engine; and a second sub tank, interposed between the common main tank and the second recording head and operable to store the ink so as to supply the ink to the second recording engine.

3. The ink jet recording apparatus as set forth in claim 2, wherein the first subtank and the second sub tank are mounted on the first carriage and the second carriage respectively.

4. The ink jet recording apparatus as set forth in claim 2, wherein the first sub tank is connected to the main tank via a first electromagnetic valve; and the second sub tank is connected to the main tank via a second electromagnetic valve.

5. The ink jet recording apparatus as set forth in claim 2, wherein:

the first sub tank and the second sub tank are provided with a first residual ink amount detector and a second residual ink amount detector, respectively; and the main tank is provided with a pump which discharges the ink stored in the main tank in accordance with signals from the first residual ink amount detector and the second residual ink amount detector.

6. The ink jet recording apparatus as set forth in claim 1, further comprising:

a first maintenance device, including at least a first capper which is associated with the first recording head; and a second maintenance device, including at least a second capper which is associated with the second recording head.

7. The ink jet recording apparatus as set forth in claim 1, further comprising:

a third flow passage operable to return the ink discharged from the first recording head to the main tank; and a fourth flow passage operable to return the ink discharged from the second recording head to the main tank.

8. The ink jet recording apparatus as set forth in claim 7, further comprising an ink purifier to filter the ink discharged from the first recording head and the second recording head.

9. The ink jet recording apparatus as set forth in claim 1, wherein a plurality of main tanks are provided so as to be associated with a plurality of colors to be recorded.

10. The ink jet recording apparatus as set forth in claim 1, further comprising:

a first table unit including the first recording engine; and a second table unit including the second recording engine, wherein the first table unit and the second table unit are vertically stackable on each other.

11. The ink jet recording apparatus as set forth in claim 1, wherein the first recording engine and the second recording engine are vertically arranged.

12. The ink jet recording apparatus as set forth in claim 1, wherein:

the first recording engine is used to perform black printing; and the second recording engine is used to perform color printing.

13. The ink jet recording apparatus as set forth in claim 1, wherein a length of the first flow passage and the second flow passage are made constant.

14. The ink jet recording apparatus as set forth in claim 1, wherein the first recording engine and the second recording engine eject the ink onto separate recording sheets.

15. The ink jet recording apparatus as set forth in claim 1, wherein the first recording engine and the second recording engine eject the ink onto separate recording sheets simultaneously.

16. The ink jet recording apparatus as set forth in claim 1, wherein a plurality of common main tanks, each storing a respective color of ink, are provided.

17. The ink jet recording apparatus as set forth in claim 1:

wherein the common main tank has a containing portion which stores a single color of ink, and wherein the containing portion supplies the single color of ink to each of the first recording engine and the second recording engine via the first flow passage and the second flow passage, respectively.

18. The ink jet recording apparatus as set forth in claim 1, wherein:

the first recording engine has a first transfer pass operable to transfer the recording sheet; and the second recording engine has a second transfer pass operable to transfer the recording sheet.

19. The ink jet recording apparatus as set forth in claim 1, further comprising:

a first subtank in the first flow passage, interposed between the common main tank and the first ink jet recording head and operable to store the ink supplied from the common main tank so as to supply the ink to the first recording engine, and a second subtank in the second flow passage, interposed between the common main tank and the second ink jet recording head and operable to store the ink supplied from the common main tank so as to supply the ink to the second recording engine, wherein the first subtank and the second subtank are different from each other.

20. The ink jet recording apparatus as set forth in claim 19, wherein the first flow passage and the second flow passage are different from each other.

21. An ink jet recording apparatus, comprising:

a plurality of recording engines, each recording engine including an ink jet recording head mounted on a separate respective carriage, such that there are a plurality of carriages, and each recording engine ejects an ink droplet onto a recording sheet to perform printing; and a common main tank, to which the plural recording engines are connected via flow passages; and a controller which compares an amount of an externally provided print data with an amount of a reference data, wherein:

each of the recording engines has a transfer pass for transferring the recording sheet and in each respective transfer pass, the ink droplet is ejected onto the recording sheet only by the inkjet recording head corresponding to one of the recording engines, such that there are a plurality of transfer passes, the controller divides the print data into data sets, each corresponding to a predetermined amount of page, and provides the data sets to the plural recording engines, when the print data amount exceeds the reference data amount; and the controller operates a single recording engine when the print data amount is less than the reference data amount.

22. An ink jet recording apparatus, adapted to be connected to a common main tank which is operable to store ink, the ink jet recording apparatus comprising:

a first recording engine, including a first carriage and a first ink jet recording head mounted on the first carriage and operable to eject the ink onto a recording sheet; and a second recording engine, including a second carriage and a second ink jet recording head mounted on the second carriage and operable to eject the ink onto the recording sheet;

a first flow passage, through which the first recording engine is connected to the common main tank to supply the ink from the common main tank to the first recording engine; and a second flow passage, through which the second recording engine is connected to the common main tank to supply the ink from the common main tank to the second recording engine.

23. The ink jet recording apparatus as set forth in claim 22, further comprising:

a first subtank in the first flow passage, interposed between the common main tank and the first ink jet recording head and operable to store the ink supplied from the common main tank so as to supply the ink to the first recording engine, and a second subtank in the second flow passage, interposed between the common main tank and the second ink jet recording head and operable to store the ink supplied from the common main tank so as to supply the ink to the second recording engine, wherein the first subtank and the second subtank are different from each other.

24. The ink jet recording apparatus as set forth in claim 23, wherein the first flow passage and the second flow passage are different from each other.

* * * * *